US007914320B2

(12) United States Patent
Ko

(10) Patent No.: US 7,914,320 B2
(45) Date of Patent: Mar. 29, 2011

(54) CABLE CONNECTOR ASSEMBLY WITH STICKY FILM

(75) Inventor: David Ko, Fullerton, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 12/615,284

(22) Filed: Nov. 10, 2009

(65) Prior Publication Data

US 2010/0120290 A1 May 13, 2010

(51) Int. Cl.
*H01R 3/00* (2006.01)

(52) U.S. Cl. ..... 439/490

(58) Field of Classification Search ..... 439/490, 439/101, 76.1, 626, 924.1, 620.22, 694, 700
See application file for complete search history.

(56) References Cited

U.S. PATENT DOCUMENTS 6,485,194 B1 * 11/2002 Shirakawa ..... 385/78
7,217,142 B1 * 5/2007 Wu ..... 439/79
7,247,046 B1 * 7/2007 Wu ..... 439/490
7,329,151 B2 * 2/2008 Wu ..... 439/607.41
7,429,188 B2 * 9/2008 Wu ..... 439/490
7,540,773 B2 * 6/2009 Ko ..... 439/581
7,581,982 B2 * 9/2009 Mehnert et al. ..... 439/490
7,736,156 B2 * 6/2010 Ko ..... 439/76.1
7,753,689 B1 * 7/2010 Wu ..... 439/63
2008/0003867 A1 * 1/2008 Wu ..... 439/490

FOREIGN PATENT DOCUMENTS

CN 201130761 10/2008

* cited by examiner

*Primary Examiner* — T C Patel
*Assistant Examiner* — Vladimir Imas
(74) *Attorney, Agent, or Firm* — Kilpatrick Townsend & Stockton LLP

(57) ABSTRACT

A cable connector assembly (100) includes an insulative housing (2), a plurality of contacts (3) received in the insulative housing, a cable (7) electrically connected with the contacts, a light guiding member (6), a cover enclosing the insulative housing and the cable, a LED covered by the light guiding member and a pair of films (9) located between the LED and one side of the insulative housing. And the films (9) are shielding a gap between the insulative housing and the cover.

20 Claims, 8 Drawing Sheets

CABLE CONNECTOR ASSEMBLY WITH STICKY FILM

BACKGROUND OF THE INVENTION

1. Field of the Invention

The present invention generally relates to a cable connector assembly, and more particularly to a cable connector assembly used for power transmission.

2. Description of Related Art

Nowadays, cable connector assemblies are widely used in an electronic equipment, especially for transmitting power, and the performance of the cable connector assembly directly impacts on the entire electronic equipment whether can normally run.

CN patent No. 201130761Y issued to Tang on Oct. 8, 2008 discloses a cable connector assembly, the cable connector assembly comprises an insulated housing, a flexible printed circuit board, a LED element and a light transmission member equipped on the flexible printed circuit board, and a cover enclosing the aforementioned elements. The flexible printed circuit board encloses the insulated housing, and the LED element is located on an outer side of the flexible printed circuit board, light from the LED element can pass through the light transmission member. The insulated housing is received in the cover, there will be a gap between the insulated housing and the cover inevitably, the light from the LED element will be diffused around, and the light through the gap on a front end of the insulated housing will pass through a receiving space of the cover, and the rest light passing through the light transmission member will be weaken, so it may be difficult for users to observe actual working status of the cable connector assembly.

Correspondingly, it is desired to have a cable connector assembly with improved shielding member to address the problems stated above.

BRIEF SUMMARY OF THE INVENTION

Accordingly, an object of the present invention is to provide a cable connector assembly having a sticky film to shield a gap between an insulative housing and a cover.

In order to achieve the above-mentioned object, a cable connector assembly in accordance with the present invention comprises an insulative housing, a plurality of contacts received in the insulative housing, a cable electrically connected with the contacts, a light guiding member, a cover enclosing the insulative housing and the cable, a LED covered by the light guiding member and a pair of films located between the LED and one side of the insulative housing. And the films are shielding a gap between the insulative housing and the cover.

Other objects, advantages and novel features of the invention will become more apparent from the following detailed description of the present embodiment when taken in conjunction with the accompanying drawings.

DETAILED DESCRIPTION OF THE INVENTION

Figure 1:
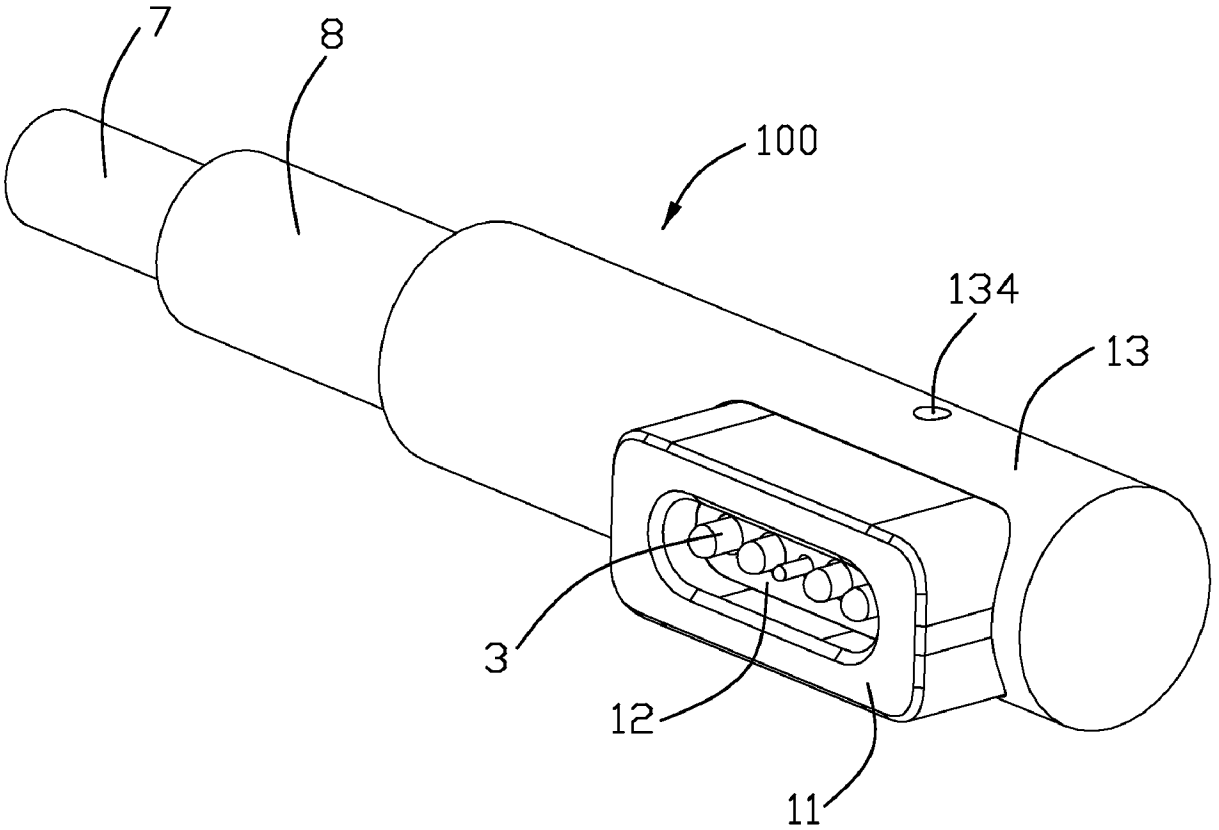
FIG. 1 is an assembled, perspective view of a cable connector assembly.

Reference will now be made to the drawing figures to describe the present invention in detail.

Figure 5:
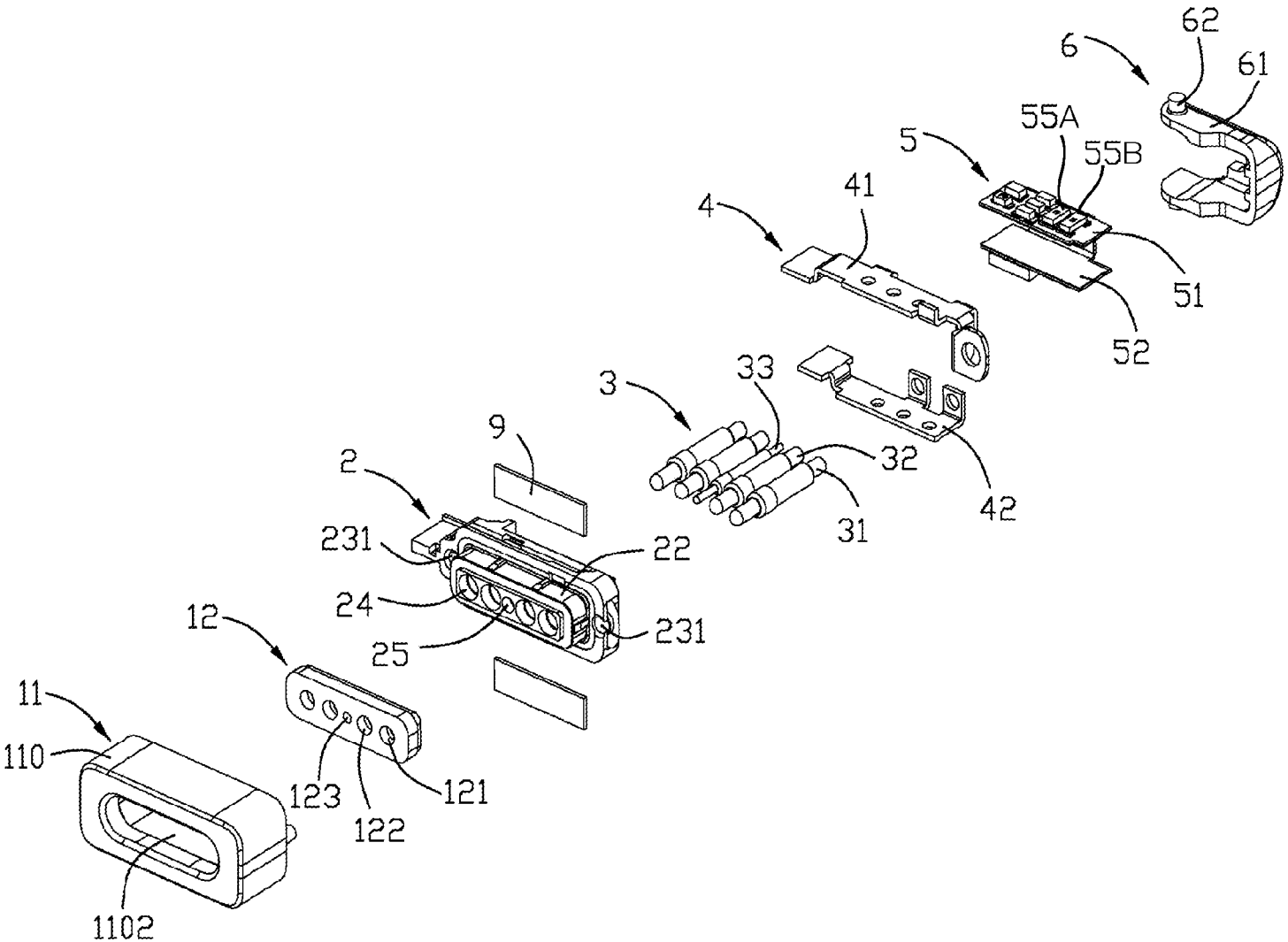
FIG. 5 is an exploded, perspective view of the cable connector assembly shown in FIG. 1.

Referring to FIG. 1 and FIG. 5, a cable connector assembly 100 in accordance with the present invention comprises an insulative housing 2, a plurality of conductive contacts 3 assembled in the insulative housing 2, a linking member 4 electrically connected with the contacts 3, a flexible printed circuit board 5 with at least one Light Emitting Diode (LED) 55A, a light guiding member 6 partially enclosing the flexible printed circuit board 5, a cable 7 electrically connected with the linking member 4, a cover and a pair of films 9 stuck on a rear face 230 of the insulative housing 2. The cable 7 is enclosing by a metallic ring 81 and a strain relief member 82 to enhance the intensity thereof.

Figure 6:
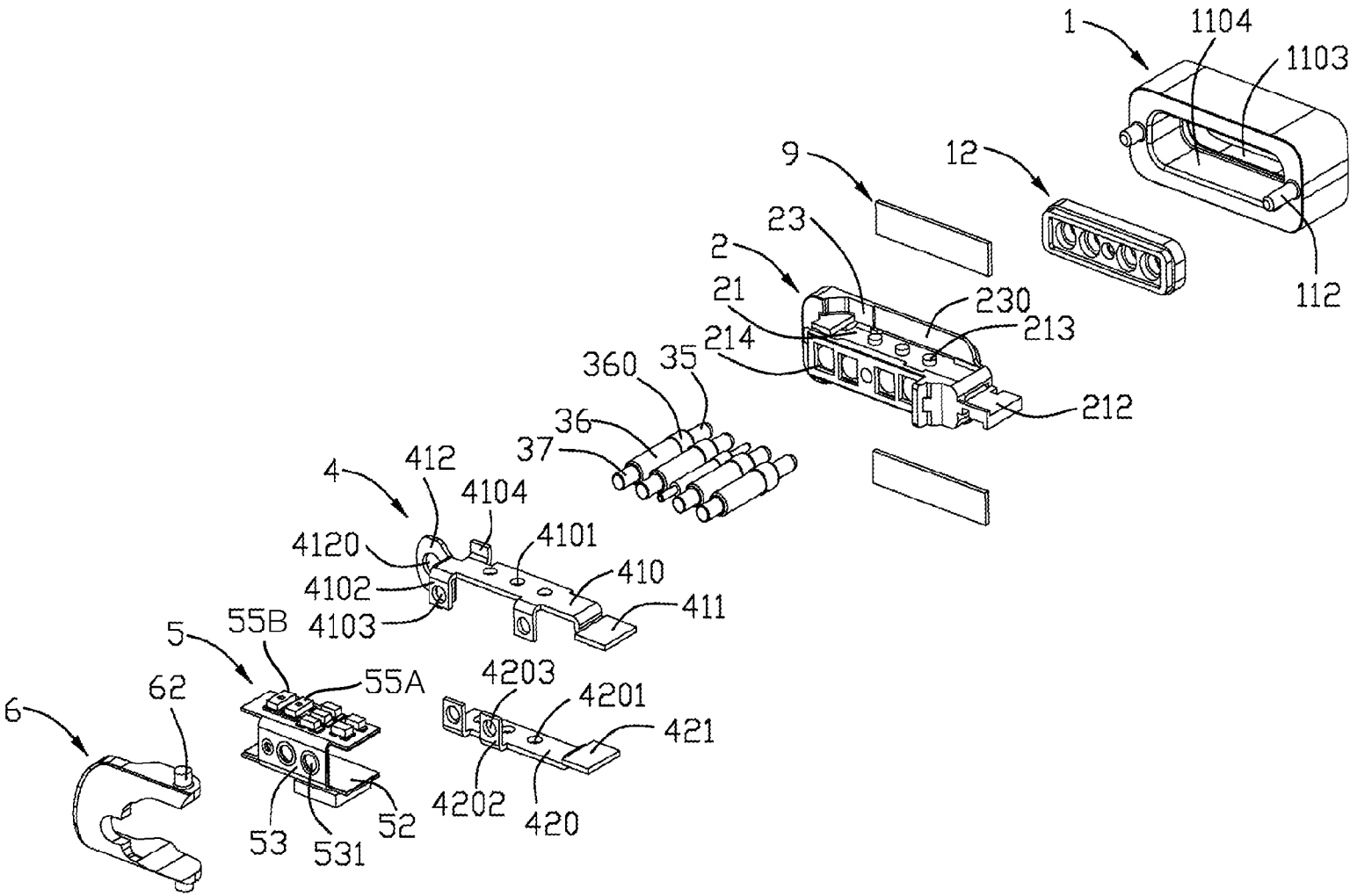
FIG. 6 is similar to FIG. 5, but viewed from another aspect.

Referring to FIGS. 5-6, the cover includes a front cover 11, a contact cover 12 and a rear cover 13. The front cover 11 is made from conductive material and capable of being attracted by a complementary connector. The front cover 11 comprises a rectangular body portion 110 and a pair of legs 112 protruding rearwards from a back face of the body portion 110 along a mating direction. A cavity 1102 is recessed from a front surface of the body portion 110 along a front-to-back direction, and the cavity 1102 comprises a first cavity 1103 in a front end thereof for receiving the complementary connector and a second cavity 1104 in a back end thereof, the first cavity 1103 is smaller than the second cavity 1104 in size.

The contact cover 12 is of rectangular shape and made of insulative material, the contact cover 12 comprises a pair of first receiving channels 121, a pair of second receiving channels 122 located between the first receiving channels 121, and a third receiving channel 123 located between the second receiving channels 122. The first receiving channels 121 and the second receiving channels 122 have the same diameter with each other, and the third receiving channel 123 have smaller diameter than the first receiving channels 121.

Figure 2:
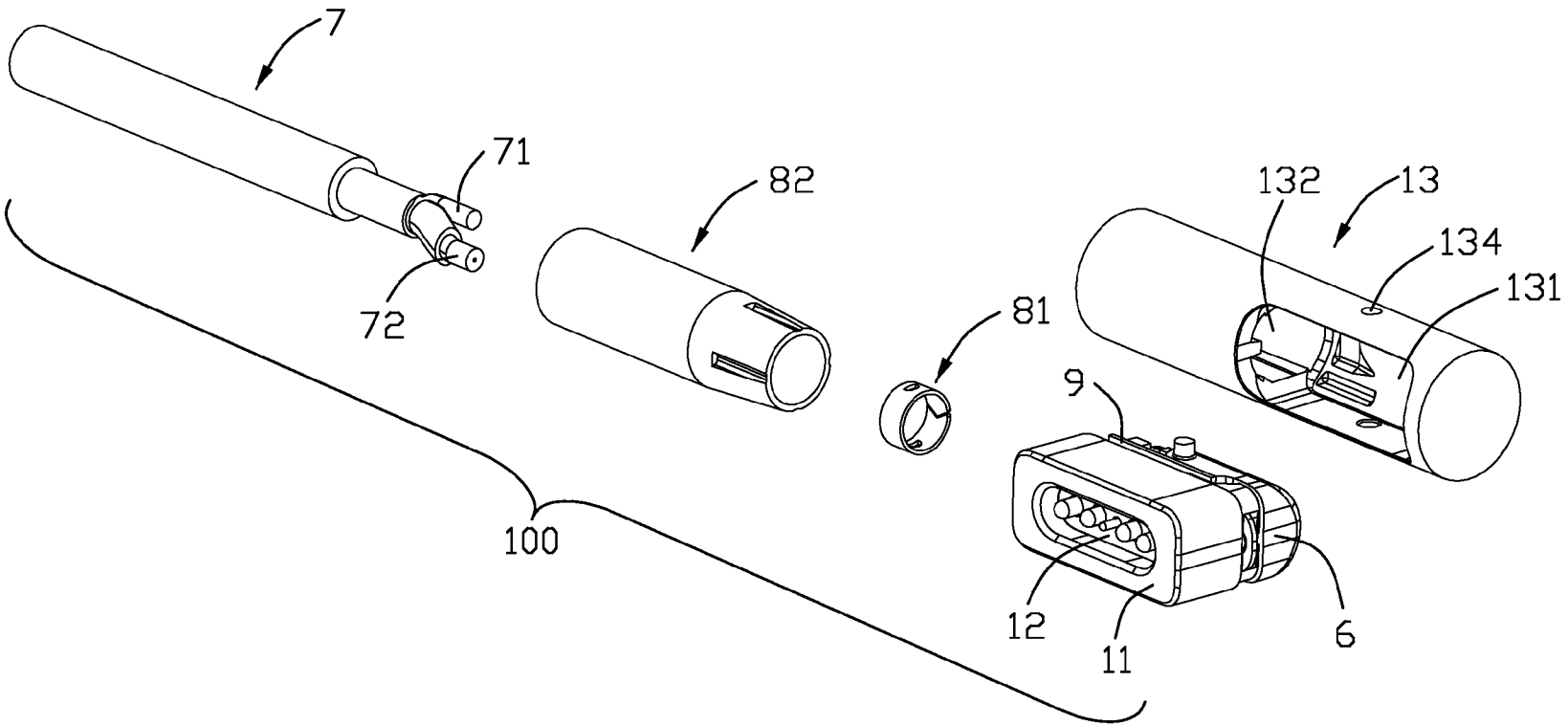
FIG. 2 is a partially exploded, perspective view of the cable connector assembly.
Figure 3:
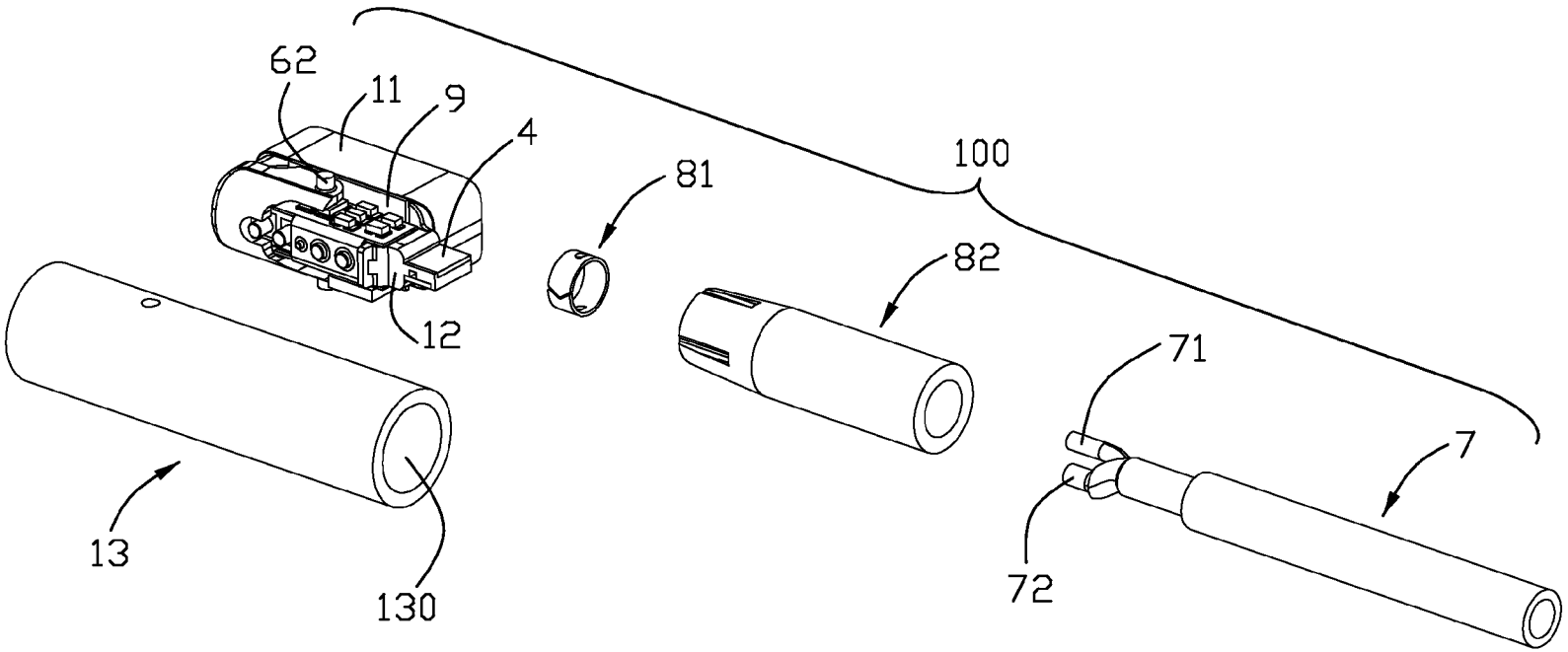
FIG. 3 is similar to FIG. 2, but viewed from another aspect.
Figure 4:
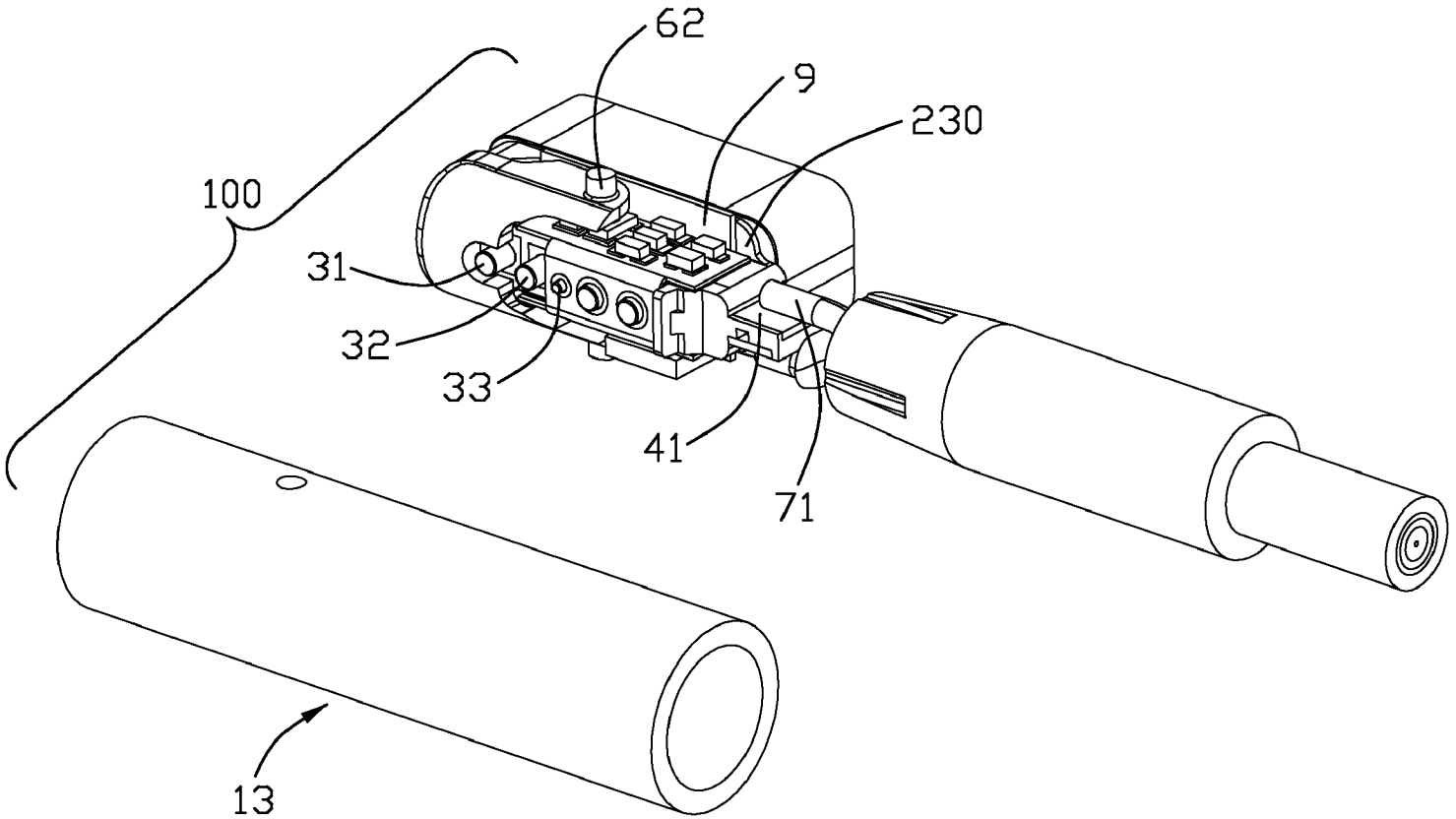
FIG. 4 is another partially exploded, perspective view of the cable connector assembly shown in FIG. 1.

Referring to FIGS. 2-3, the rear cover 13 is of sleeve shape, and defined an obturated end and another end with a hole 130 in axial direction. The rear cover 13 defines a sleeve receiving portion 132 along the axial direction and an opening 131 recessed from a front end thereof. The rear cover 13 is made from plastic material in the embodiment in accordance with the present invention, and also can be made of metallic material in other embodiments to enhance the intensity thereof. The rear cover 13 also has a pair of engaging holes 134 on top and bottom sides thereof, the engaging holes 134 are aligned with each other along a direction perpendicular to the mating direction.

Referring to FIGS. 5-6, the insulative housing 2 comprises a base portion 21 and a tongue portion 22 extending forwardly from the base portion 21, an enlarged portion 23 is arranged between the base portion 21 and the tongue portion 22. The insulative housing 2 defines two pairs of large-size first receiving passages 24 and a center small-size second receiving passage 25 respectively recessed from a front face thereof to a rear face thereof. The enlarged portion 23 defines a pair of first mounting holes 231 on both sides for receiving the legs 112 of the front cover 11. The base portion 21 has a supporting portion 212 extending outwards from one side thereof and a plurality of positioning tabs 213 on top and bottom side thereof. The base portion 21 has four rectangular receiving apertures 214 recessed forwards from a back face thereof, the receiving apertures 214 are located behind the first receiving passages 24 and communicated with the corresponding first receiving passages 24.

The conductive contacts 3 consist of a pair of ground contacts 31, a pair of power contacts 32 located between the pair of ground contacts 31 and a center detect contact 33 located between the pair of power contacts 32. Each contact 3 is of a POGO Pin type, that is to say, there is a spring (not shown) inside the contact 3, thus, when mating, front contacting portion 35 of the contact 3 can be pressed to rearward move along the mating direction. Each ground contact 31 comprises the column-shape contacting portion 35 with a relatively small diameter and capable of being compressed, a column-shape media portion 36 with a relatively large diameter, and an end portion 37 formed at rear end of the media portion 36 with a column-shape and smaller diameter. An expansion portion 360 is protruding outwards from an exterior surface of each media portion 36. The power contact 32 has the same structure as that of the ground contact 31 except the contacting portion 35 thereof has a length shorter than that of the ground contact 31. Thus, the ground contacts 31 will firstly mate with re complementary connector and lastly disengage from the complementary connector for assuring safe power and signal transmission. The detect contact 33 has the same structure as that of the power contact 32 except each portion thereof has a smaller diameter than that of the power contact 32.

The linking member 4 is located outside the insulative housing 2, and includes a first linking portion 41 and a second linking portion 42 below the first linking portion 41. The first linking portion 41 and the second linking portion 42 have the same configuration with each other and are opposite to each other. The first linking portion 41 comprises a main portion 410, a first soldering portion 411 extending horizontally from one side of the main portion 410 and an ear portion 412 extending from another side of the main portion 410 and located on a plane vertical to the main portion 410. The first soldering portion 411 is parallel to the main portion 410 and lower than the main portion 410. The ear portion 412 defines a second mounting hole 4120 aligned with the first mounting hole 231 of the insulative housing 2 along the mating direction. The main portion 410 has a plurality of positioning holes 4101, a pair of first curving portions 4102 are bent downwards from a back end thereof and a third curving portion 4104 is bent upwards from a front end thereof, and each first curving portion 4102 defines a first soldering hole 4103. The first curving portions 4102 are parallel to the third curving portion 4104 and vertical to the main portion 410.

The second linking portion 42 has a second soldering portion 421 aligned with the first soldering portion 411. The second linking portion 42 has a plurality of second positioning holes 4201 on a main portion 420 thereof and a pair of second curving portions 4202 bending upwards from a back end thereof. Each second curving portion 4202 defines a second soldering hole 4203. The pair of second curving portions 4202 are located between the pair of first curving portions 4102.

The linking member 4 is insert-molded in the insulative housing 2 in this embodiment according to the present invention, in other alternative embodiment, the linking member 4 and the insulative housing 2 can be molded respectively and assembled to each other. The first soldering portion 411 and the second soldering portion 421 are located on a top surface and a bottom surface of the supporting portion 212 of the insulative housing 2 respectively, and the third curving portion 4104 of the first linking portion 41 and part of the ear portion 412 are molded in the insulative housing 2, the first curving portions 4102 and the second curving portions 4202 are received in the receiving apertures 214 of the insulative housing 2.

The flexible printed circuit board 5 includes an upper board 51, a lower board 52 and a connecting board 53 linking the upper board 51 and the lower board 52, the upper board 51 including LEDs 55A and 55B and the lower board 52 including LEDs 54A and 54B (as show in FIG. 7), and the connecting board 53 is vertical to the upper board 51 and the lower board 52, and has a number of conductive holes 531.

Figure 7:
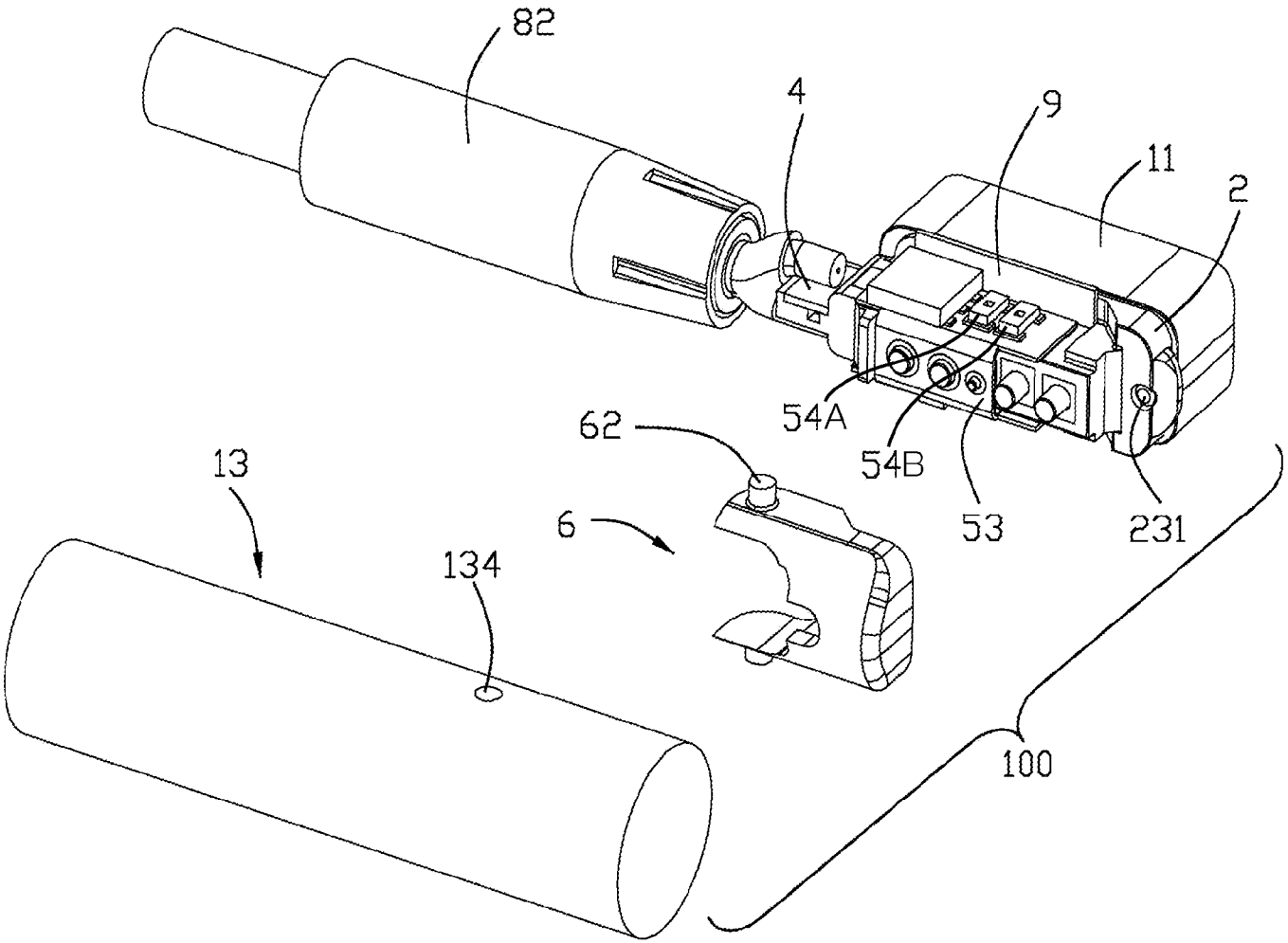
FIG. 7 is a partially exploded, perspective view of the cable connector assembly shown in FIG. 4.
Figure 8:
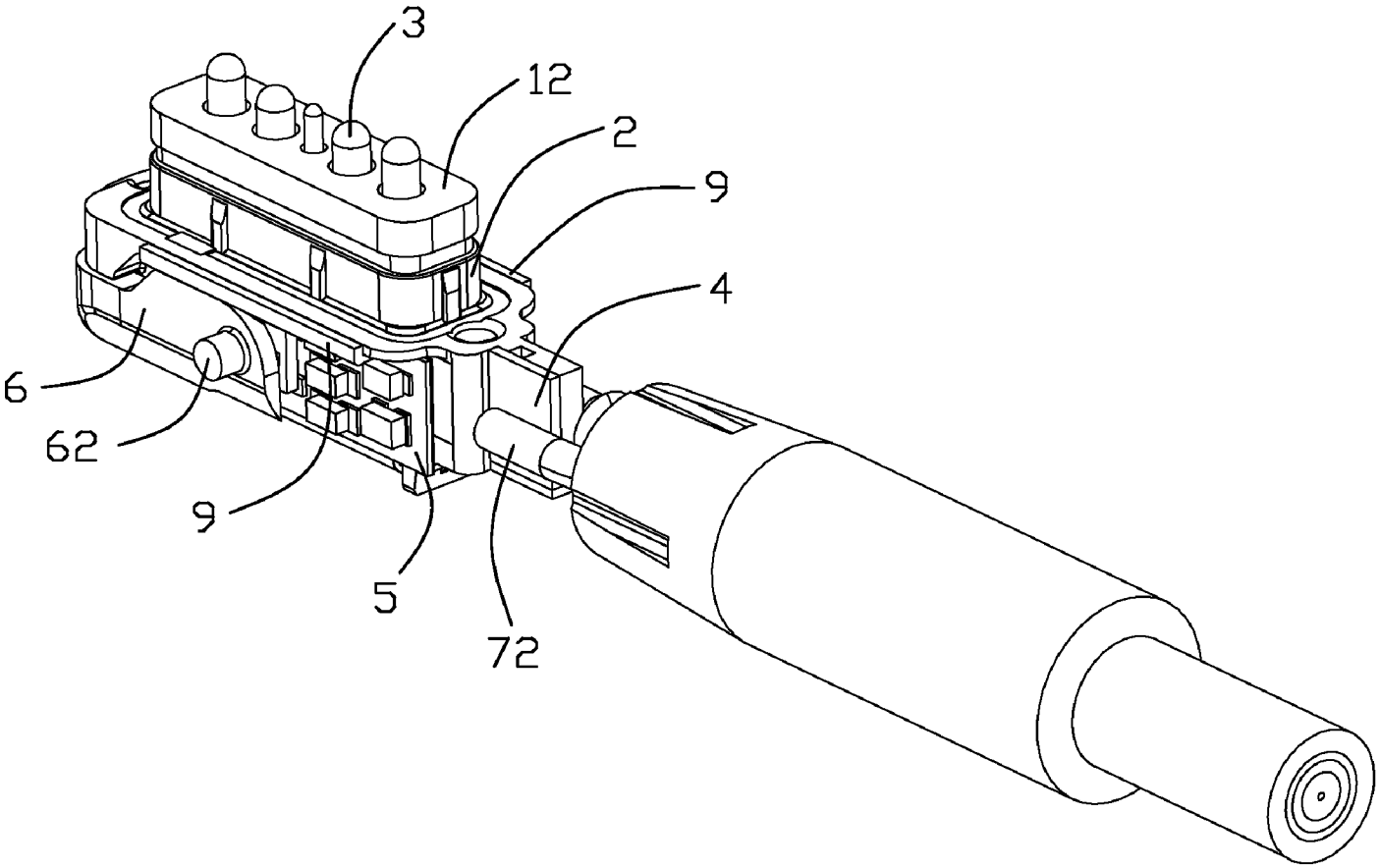
FIG. 8 is a partially assembled, perspective view of the cable connector assembly with a film bending when assembled in a cover.

The light guiding member 6 is of U-shaped and made of transparent or semitransparent material, and the light emitted from the LEDs 55A and 55B (and 54A and 54B, as shown in FIG. 7) is capable of being spread out through the light guiding member 6 to outside. Two arms 61 cover on the corresponding LEDs 55A and 55B (and 54A and 54B, as shown in FIG. 7) on the flexible printed circuit board 5, and a column 62 is defined on each arm 61 and protruding outwards. The light guiding member 6 is secondary formed in the rear cover 13, and the columns 62 are accommodated in the engaging holes 134 of the rear cover 13.

The cable 7 comprises a wire, a metal braiding layer surrounding the wire, and an outer jacket enclosing the metal braiding layer. A front portion of the outer jacket is stripped to expose part of the wire and the metal braiding layer. The wire comprises a plurality of inner conductors 71, 72 and an insulated layer.

The cable 7 is enclosed by a metallic ring 81 and a strain relief member 82 molded on the cable 7 and the metallic ring 81, the metallic ring 81 together with the strain relief member 82 serve as a strain relief mechanism 8.

The upper part and the lower part of the insulative housing 2 are stuck with a film 9 respectively to keep out the light emitted from the LEDs 54A and 54B (and 55A and 55B, as shown in FIG. 6), and each film 9 is of flaky shape and made of black material or other deep color, the films 9 are stuck to the rear face 230 of the insulative housing 2.

Referring to FIGS. 2-4 and FIGS. 7-8, when assembling, the cable 7 with the metallic ring 81 and the strain relief member 82 is assembled through the sleeve receiving portion 132 of the rear cover 13, and then inserted into the opening 131, a front part of the cable 7 is pulled out from the opening 131 to make the inner conductors 71, 72 be soldered to the first soldering portion 411 and the second soldering portion 421 of the linking member 4. The contacts 3 are assembled to the insulative housing 2, the media portions 36 of the ground contacts 31 and the power contacts 32 are received in corresponding first receiving passages 24 respectively, and the media portion 36 of the detect contact 33 is received in the second receiving passage 25, rear segments of the media portions 36 extend beyond a rear face of the insulative housing 2, the contacting portions 35 are located beyond a front face of the insulative housing 2. The end portions 37 of the contacts 3 are soldered to the linking member 4, with the end portions 37 of the ground contacts 31 soldered in the first soldering holes 4103 of the first linking portion 41, and the end portions 37 of the power contacts 32 soldered in the second soldering holes 4203 of the second linking portion 42. The flexible printed circuit board 5 is electrically connecting with the linking member 4 and the cable 7 via the conductive holes 531 of the connecting board 53 being soldered with the corresponding contacts 3.

Then, the contact cover 12 is assembled to the insulative housing 2 along the front-to-back direction, the expansion portions 360 of the contacts 3 are retained in the contact cover 12, and the contacting portions 35 are exposed out of the contact cover 12. The films 9 are stuck to the rear face 230 of the insulative housing 2, then the aforementioned elements are assembled to the rear cover 13 from front-to-back direction, the columns 62 are located behind the films 9, the upper film 9 is partially exposed beyond a top surface of the insulative housing 2, and the lower film 9 is partially exposed beyond a bottom surface of the insulative housing 2, when the insulative housing 2 is moved from front-to-back direction, the portions of the films 9 beyond the insulative housing 2 are curved forwardly by a resistance of an inner wall of the rear cover 13 (shown in FIG. 8), so the gap between the insulative housing 2 and the rear cover 13 will be shielded by the films 9, to prevent the light emitted from the LEDs 54A and 54B (and 55A and 55B, as shown in FIG. 6) from passing through the gap. Finally, the front cover 11 is assembled to the rear cover 13 from front-to-rear direction, the legs 112 of the front cover 11 are inserted into the first mounting holes 231 of the insulative housing 2, and then inserted into the second mounting hole 4120 of the first linking portion 41.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly, comprising:

an insulative housing and a plurality of contacts received in the insulative housing;

a cable electrically connected with the contacts;

a light guiding member;

a cover enclosing the insulative housing and the cable;

an LED covered by the light guiding member;

a pair of films to shield a gap between the insulative housing and the cover; and a flexible printed circuit board, wherein the flexible printed circuit board comprises an upper board, a lower board, and a connecting board linking the upper board and the lower board, and wherein the LED is arranged on an exterior side of the flexible printed circuit board.

2. The cable connector assembly as claimed in claim 1, wherein the films are of deep color.

3. The cable connector assembly as claimed in claim 1, wherein the films are stuck on a rear face of the insulative housing, and an upper segment and a lower segment of the films are curved forwards.

4. The cable connector assembly as claimed in claim 1, wherein the connecting board is perpendicular to the upper board and the lower board, and defines a plurality of conductive holes.

5. The cable connector assembly as claimed in claim 1, wherein the LED is one of a first pair of LEDs located on a top of the upper board, the cable connector assembly further comprising a second pair of LEDs located on a bottom of the lower board.

6. The cable connector assembly as claimed in claim 5, wherein the light guiding member covers the first pair of LEDs and the second pair of LEDs.

7. A cable connector assembly, comprising:

an insulative housing and a plurality of contacts received in the insulative housing;

a cable electrically connected with the contacts;

a light guiding member;

a cover enclosing the insulative housing and the cable;

an LED covered by the light guiding member; and a pair of films to shield a gap between the insulative housing and the cover, wherein a linking member is defined on a top surface and a bottom surface of the insulative housing, and a part of the linking member is embedded in the insulative housing.

8. The cable connector assembly as claimed in claim 7, wherein the cable is soldered to the linking member.

9. The cable connector assembly as claimed in claim 7, wherein the linking member comprises a first linking portion and a second linking portion, the first linking portion defines a pair of first curving portions bent downwards from a back end thereof, the second linking portion defines a pair of second curving portions bent upwards from a back end thereof, each first curving portion has a first soldering hole and each second curving portion has a second soldering hole.

10. The cable connector assembly as claimed in claim 9, wherein each contact is of POGO-type and comprises a contacting portion being capable of being compressed when mating with the complementary connector.

11. The cable connector assembly as claimed in claim 10, wherein the contacts comprise a pair of ground contacts and a pair of power contacts located between the pair of ground contacts.

12. The cable connector assembly as claimed in claim 11, wherein the ground contacts are soldered in the first soldering holes with the power contacts soldered in the second soldering holes.

13. The cable connector assembly as claimed in claim 7, further comprising a flexible printed circuit board, the flexible printed circuit board comprising an upper board and a lower board.

14. The cable connector assembly as claimed in claim 13, wherein the LED is one of a first pair of LEDs located on a top of the upper board, and further comprising a second pair of LEDs located on a bottom of the lower board.

15. A cable connector assembly, comprising:

an insulative housing with a plurality of contacts received therein;

a cable electrically connected to the contacts;

a cover enclosing the insulative housing and having an engaging hole;

a flexible printed circuit board, the flexible printed circuit board comprising an upper board, a lower board, and a connecting board linking the upper board and the lower board, wherein an LED is arranged on an exterior side of the flexible printed circuit board;

a light guiding member having a column protruding outwards to insert into the engaging hole, the column being located on the LED and being capable of conducting light emitted from the LED; and a film stuck on the insulative housing.

16. The cable connector assembly as claimed in claim 15, wherein the film is curved to shield a gap between the insulative housing and the cover.

17. The cable connector assembly as claimed in claim 15, wherein the LED is located on a top of the upper board, and further comprising a second LED located on a bottom of the lower board.

18. The cable connector assembly as claimed in claim 15, further comprising a linking member on a top surface and a bottom surface of the insulative housing, wherein part of the linking member is embedded in the insulative housing.

19. A cable connector assembly, comprising:

an insulative housing and a plurality of contacts received in the insulative housing;

a linking member on a top surface and a bottom surface of the insulative housing, wherein part of the linking member is embedded in the insulative housing;

a cable electrically connected with the contacts;

a light guiding member;

a cover enclosing the insulative housing and the cable;

an LED covered by the light guiding member; and at least one film located to seal a gap between the insulative housing and the cover.

20. The cable connector assembly as claimed in claim 19, further comprising a flexible printed circuit board, the flexible printed circuit board comprising an upper board and a lower board.

* * * * *